US006280024B1

(12) United States Patent
Miyazawa et al.

(10) Patent No.: US 6,280,024 B1
(45) **Date of Patent: *Aug. 28, 2001**

(54) INK CARTRIDGE FOR PRINTER

(75) Inventors: Hisashi Miyazawa; Munehide Kanaya; Seiji Mochizuki, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/474,562

(22) Filed: Jun. 7, 1995

Related U.S. Application Data

(63) Continuation-in-part of application No. 08/334,719, filed on Nov. 4, 1994.

(30) Foreign Application Priority Data

Nov. 5, 1993 (JP) ..... 5-301151

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 4,400,102 | | 8/1983 | Shiurila et al. | 400/124.1 |
| 4,447,820 | | 5/1984 | Terasawa | 347/86 |
| 4,506,277 | | 3/1985 | Terasawa | 347/24 |
| 4,591,875 | | 5/1986 | McCann | 347/86 |
| 4,628,333 | * | 12/1986 | Terasawa | 347/87 |
| 4,658,273 | * | 4/1987 | Yuki et al. | 347/86 |
| 5,025,271 | * | 6/1991 | Baker et al. | 347/87 |
| 5,156,470 | | 10/1992 | Suzuki et al. | 400/124.1 |
| 5,156,473 | | 10/1992 | Suzuki et al. | 400/124.1 |
| 5,280,299 | * | 1/1994 | Saikawa et al. | 347/87 |
| 5,526,030 | | 6/1996 | Baldwin et al. | 347/87 |
| 5,537,134 | * | 7/1996 | Baldwin et al. | 347/85 |
| 5,600,358 | * | 2/1997 | Baldwin et al. | 347/87 |

FOREIGN PATENT DOCUMENTS

| | | | | |
|---|---|---|---|---|
| 2709730A1 | | 9/1978 | (DE) . | |
| 2916472 | | 11/1980 | (DE) . | |
| 529880 | * | 3/1993 | (EP) | 347/87 |
| 0633138A2 A3 | | 1/1995 | (EP) . | |
| 2003793 A | | 3/1979 | (GB) . | |
| 140847 | * | 6/1987 | (JP) | 347/86 |
| A 63 162249 | | 7/1988 | (JP) . | |
| A 63 276554 | | 11/1988 | (JP) . | |
| 424133 | * | 4/1991 | (JP) | 347/87 |
| 4-144755 | | 5/1992 | (JP) . | |

OTHER PUBLICATIONS

Photographs of Epson Stylus 800.

* cited by examiner

*Primary Examiner*—John Barlow
*Assistant Examiner*—Michael S. Brooke
(74) *Attorney, Agent, or Firm*—Stroock & Stroock & Lavan, LLP

(57) ABSTRACT

An ink cartridge for mounting on an ink supply needle of a recording head is provided. An ink cartridge main body having a plurality of walls and an ink supply port disposed in a wall of said ink cartridge main body and communicating from the interior to the exterior of the ink cartridge for the flow of ink through the ink supply port are also provided. A cover is adapted to seal said ink cartridge main body and is formed with an ambient air vent in the cover which is in fluid communication with ambient air through a circuitous channel formed in the cover. A second air vent is also formed in the cover and is also in fluid communication with the circuitous channel. The interior of the ink cartridge main body is thus placed in fluid communication with ambient air through the circuitous channel while preventing any ink contained in the ink tank main body from evaporating.

24 Claims, 7 Drawing Sheets

FIG. 1(a)
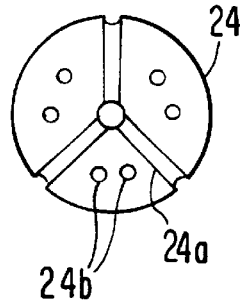
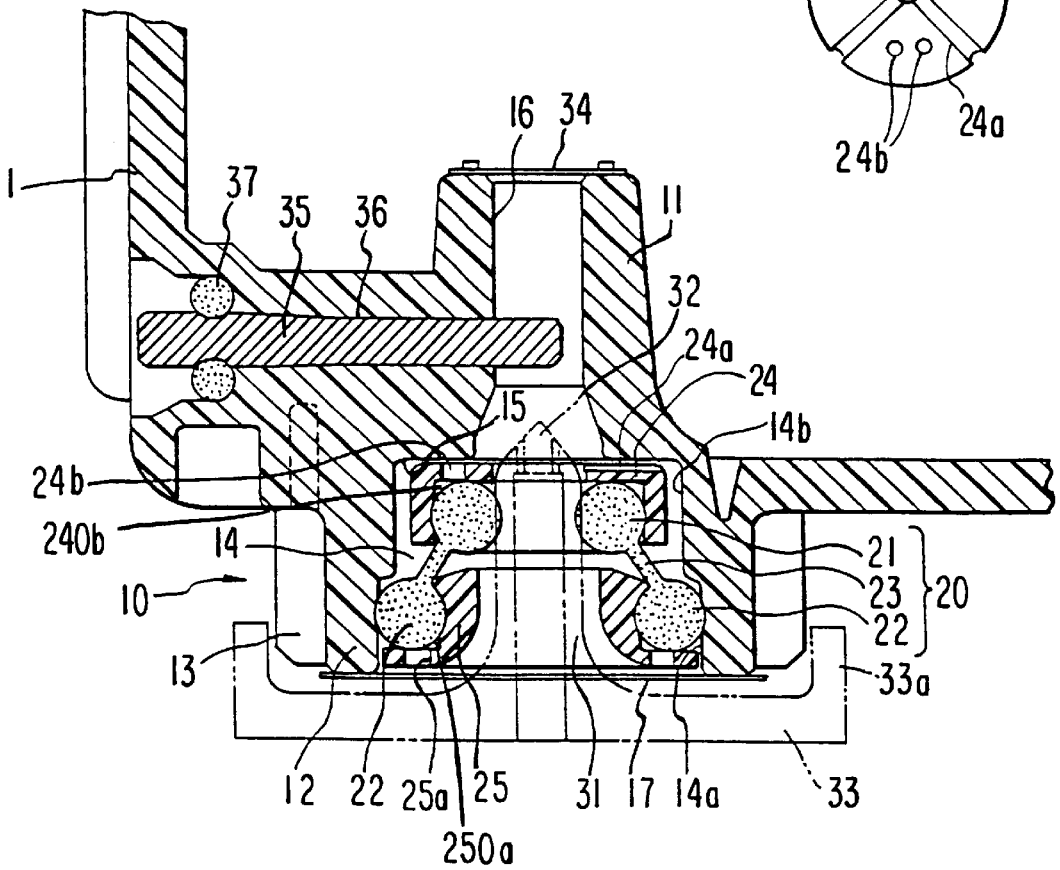
FIG. 1

INK CARTRIDGE FOR PRINTER

CROSS REFERENCE TO RELATED APPLICATION

This is a continuation-in-part application of copending U.S. patent application Ser. No. 08/334,719 filed on Nov. 4, 1994.

BACKGROUND OF THE INVENTION

The present invention relates generally to an ink cartridge for use with an ink-jet type recording apparatus and, more particularly, to an ink cartridge for use with an ink-jet type recording apparatus which compensates for misalignment of the ink supply port and ink supply needle to stop any ink from leaking.

Ink-jet type recording apparatuses use liquid ink to print recording data. Particularly, an ink-jet type recording apparatus employs an ink cartridge that supplies ink contained therein to the recording head. The ink cartridge is directly connected to the recording head through the use of an ink supply needle mounted on the recording head. Ink is delivered by utilizing a pressure difference between the ink in the recording head and the ink in the ink cartridge, and by capillary forces.

As a result of this construction, the ink cartridge is required to have a structure for connecting the ink cartridge to the ink supply needle. This structure is disposed either on the lower surface of the ink cartridge or below the ink cartridge itself. This arrangement of the connecting structure in turn requires that an appropriate measure be taken to contain leakage of ink from the ink cartridge when the cartridge is connected to the ink supply needle. As has already been disclosed in Japanese Unexamined Patent Publication No. 50-74341, one method of dealing with the leaking of ink which is widely used is to employ a packing having a through-hole and a seal that allows the ink supply needle to be hermetically fitted into this through-hole at the ink supply port of the ink cartridge. With this structure, the ink cartridge can be positioned and retained in contact with the recording head without allowing any ink to leak by inserting the ink supply needle into the through-hole of the packing so as to pierce the seal.

In order to prevent any ink from leaking, the ink supply port provided on the ink cartridge must have a minimal diameter. This design further requires a minimal diameter for the through-hole in the packing that is disposed in the ink supply port. However, if the ink supply needle is not positioned precisely coaxial with the through-hole in the packing disposed in the ink supply port, or if the ink supply needle is not perfectly perpendicular with respect to the packing disposed in the ink supply port, then the ink supply needle will not be centered upon insertion into the through-hole of the packing. As a result, the ink supply needle will be in contact with only a portion of the packing, whereas the remaining portion of the packing will not come in contact with the ink supply needle. Thus, ink will leak from between the ink supply needle and the packing where the ink supply needle does not contact the packing.

This problem of leaking ink also arises from inconsistent positioning tolerances among the multiple ink supply needles in a recording head for a color printer using more than one ink supply needle to supply color inks to a recording head from a plurality of color ink tanks. In many cases, the plurality of color ink tanks is provided as a plurality of compartments in a single tank, so that the spacing between the connecting structures of the ink tank compartment and between the respective ink supply needles is fixed, aggravating the tolerance problem.

In addition, an ink tank must be ventilated in order to equalize pressure differences for the printer to work properly. However, ventilation of an ink cartridge often results in some of the ink evaporating during use, especially if the ink cartridge is used infrequently.

Accordingly, the present invention provides an ink tank with a seal which compensates for inconsistent positioning of ink-supply needles, or inconsistent inclines of ink-supply needles and keeps ink from leaking from the ink supply tank while in use. The present invention also provides an ink tank which is ventilated, but protects against the evaporation of the ink contained therein.

SUMMARY OF THE INVENTION

Generally speaking, in accordance with the present invention, a novel ink cartridge is provided which is capable of compensating for any displacement of the ink supply needle with respect to the ink supply port at the time the ink supply needle is connected to the ink supply port. The needle and port can be connected without allowing the ink to leak.

The ink cartridge of the present invention comprises a self-aligning ring operatively coupled to the ink supply port of the ink cartridge on the outlet or recording head side. In operation, the ink supply port is coupled with an ink supply needle emanating from the recording head through the self aligning ring. The self-aligning ring includes: a first annular seal member whose inner diameter is slightly smaller than an outer diameter of the ink supply needle; a second annular seal member whose outer diameter is slightly larger than an inner diameter of the ink supply port; and a thin connecting member for connecting the two seal members. When coupled, even if the ink supply needle is not located precisely coaxial with the ink supply port, the ink supply needle can be connected to the ink supply port hermetically by flexing the thin connecting member, thereby eliminating any leaking of the ink.

The ink cartridge of the present invention also comprises an ink cartridge main body having a plurality of walls and having an ink supply port disposed in a wall of the ink cartridge main body and communicating from the interior to the exterior of the ink cartridge for the flow of ink therethrough. A cover seals the ink cartridge main body. An ambient air vent is formed in the cover for permitting ambient air into the ink cartridge. A circuitous groove is formed in the cover. A groove seal member is fixed to the inside surface of the cover, sealing the groove so as to form the grooves into channels which are in fluid communication with the ambient air vent. A second air vent is also formed in the cover and is also in fluid communication with the circuitous groove so that the interior of the ink cartridge main body is placed in fluid communication with ambient air through the circuitous groove. Thus, the ink cartridge is ventilated, and ink contained in the ink tank main body is kept from evaporating.

Accordingly, it is an object of this invention to provide an improved ink transfer mechanism for transferring ink between an ink cartridge and a recording head.

Another object of the invention is to provide an improved ink transfer mechanism capable of compensating for any misalignment of the ink supply needle with respect to the ink supply port during use.

A further object of the invention is to provide an improved ink transfer mechanism wherein a self-aligning ring permits a hermetic seal between an ink cartridge and a recording head regardless of misalignment of the ink supply needle with respect to the ink supply port during use.

It is yet a further object of the invention to provide an ink cartridge which is properly ventilated yet protects against the evaporation of ink therefrom.

Still other objects and advantages of the invention will in part be obvious and will in part be apparent from the specification and drawings.

The invention accordingly comprises the features of construction, combination of elements, and arrangement of parts, which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a fragmentary enlarged cross-sectional view of an ink cartridge and recording head combination constructed in accordance with a preferred embodiment of the present invention and FIG. 1(*a*) is a top plan view of the fixed bush depicted in FIG. 1;

DETAILED DESCRIPTION OF THE PREFERRED EMBODIMENTS

Figure 2:
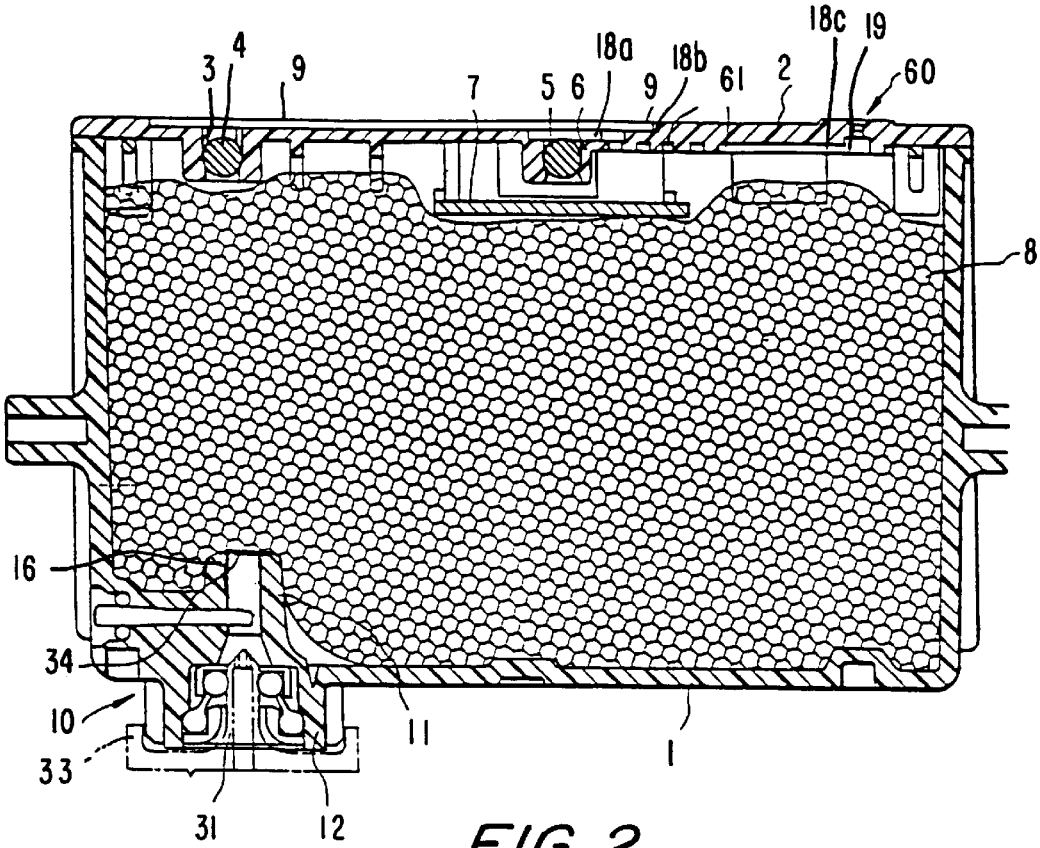
FIG. 2 is a cross-sectional view of the ink cartridge of FIG. 1 constructed in accordance with a preferred embodiment of the present invention shown mounted on an ink supply needle.

FIGS. 1 and 2 show an ink cartridge constructed in accordance with a first embodiment of the present invention. The ink cartridge of this embodiment is designed for monochromatic printers. Referring to FIG. 2, an ink cartridge main body, indicated generally as 1, is integrally formed into a box having an opening on top. Ink cartridge main body 1 is made of a resin material that suppresses evaporation of ink and is constructed to allow air passage.

Figure 9:
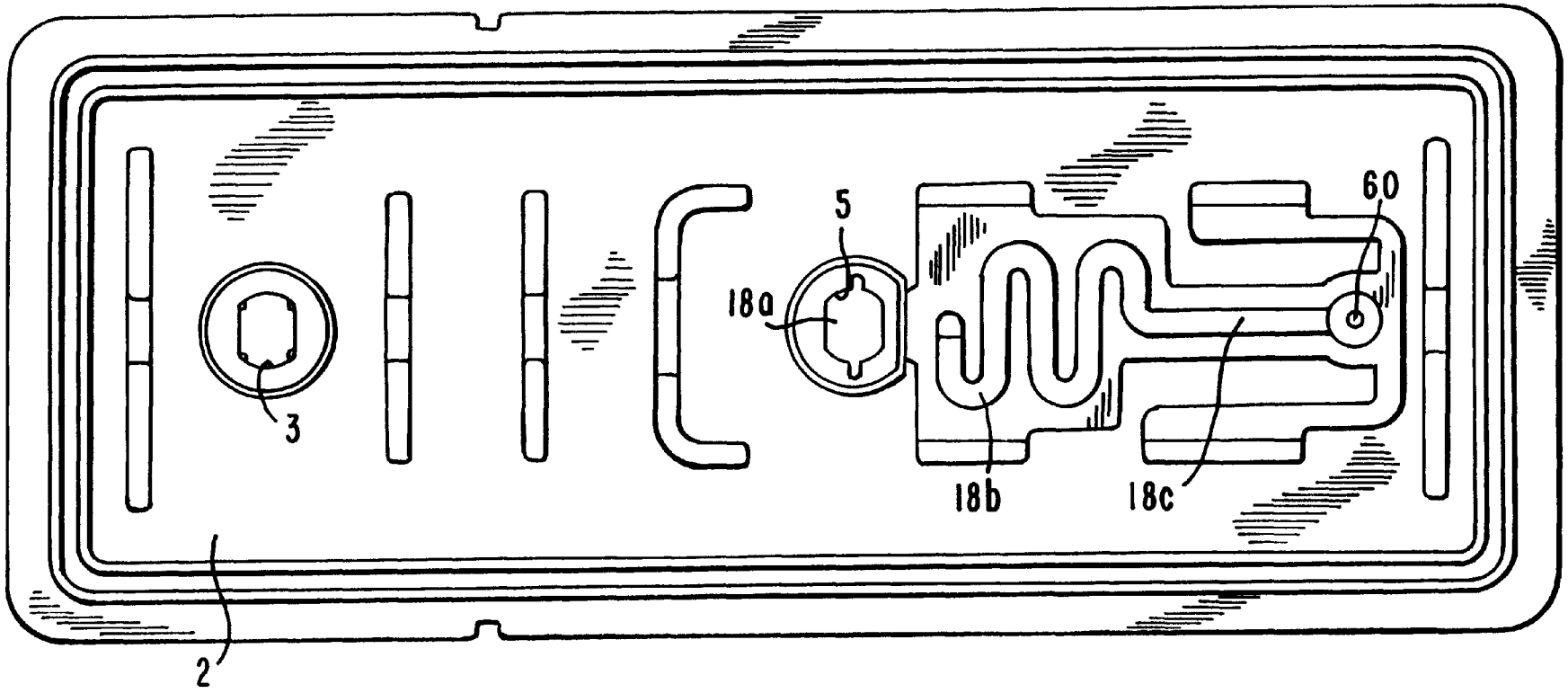
FIG. 9 is a bottom view of the cover shown in FIG. 2.

The upper opening of ink cartridge main body 1 is covered integrally with a cover 2 having both an ink charging port 3 sealed by a spherical stopper 4 and an air vent 5 similarly sealed by a spherical stopper 6 designed to permit air flow into the ink cartridge while preventing ink loss. The air vent 5 communicates with atmosphere through an air communication passage 61 and an air communication hole 60. (FIG. 9). The air communication hole 60 is previously sealed before the ink cartridge is used to avoid leaking ink. The area over stoppers 4 and 6 itself is sealed by a sheet member 9 after ink is loaded into the cartridge. Cover 2 is formed to define a first 18*a* between air vent 5 and sheet member 9, a straight channel 18*c* between the underside of the cover and sheet member 19 sealing the straight channel 18*c* from the ink in the cartridge, and a circuitous channel 18*b* leading from space 18*a* and straight channel 18*c* and sealed by sheet member 19 (straight channel 18*c* and channel 18*b* defining winding passage 61); air vent 5 and ambient air vent 60 in fluid communication with each other and with ambient air. When ink cartridge 1 is in an upright position, spherical stopper 6 and air vent 5 are designed to allow air to pass from ambient air vent 60 through air communication passage 61, through air vent 5 and into ink cartridge 1. However, if the ink cartridge is turned over, spherical stopper 6 moves into a position blocking air communication passage 61, thus retaining the ink in ink cartridge 1.

An ink supply port, indicated generally as 10, is formed on one side of the bottom of ink cartridge main body 1. Ink supply port 10 communicates with an ink supply needle 31 of a recording head (not shown). Further, an ink absorbing member 8, formed of a flexible porous material, is disposed within main body 1. A biasing plate 7 is positioned with respect to cover 2 to form a gap between cover 2 and ink absorbing member 8. The ink supply needle is positioned relative to the ink cartridge by a positioning member 33 which is dimensioned to receive an outwardly projecting portion 12 of the ink receiving and transmitting portion of the ink cartridge which defines the ink supply port.

Figure 6:
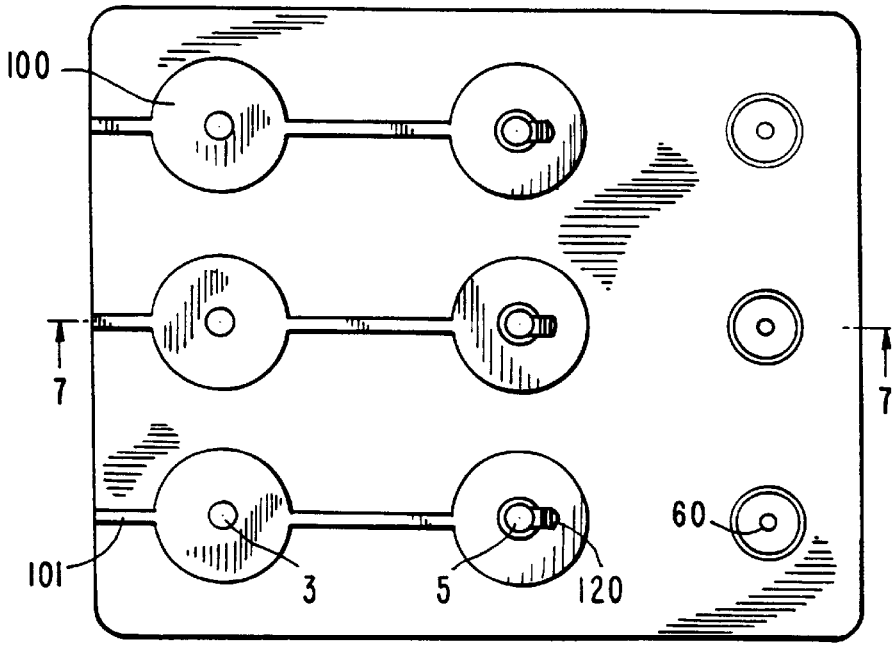
FIG. 6 is a top plan view of a cover constructed in accordance with a second embodiment of the present invention with a seal member removed.
Figure 8:
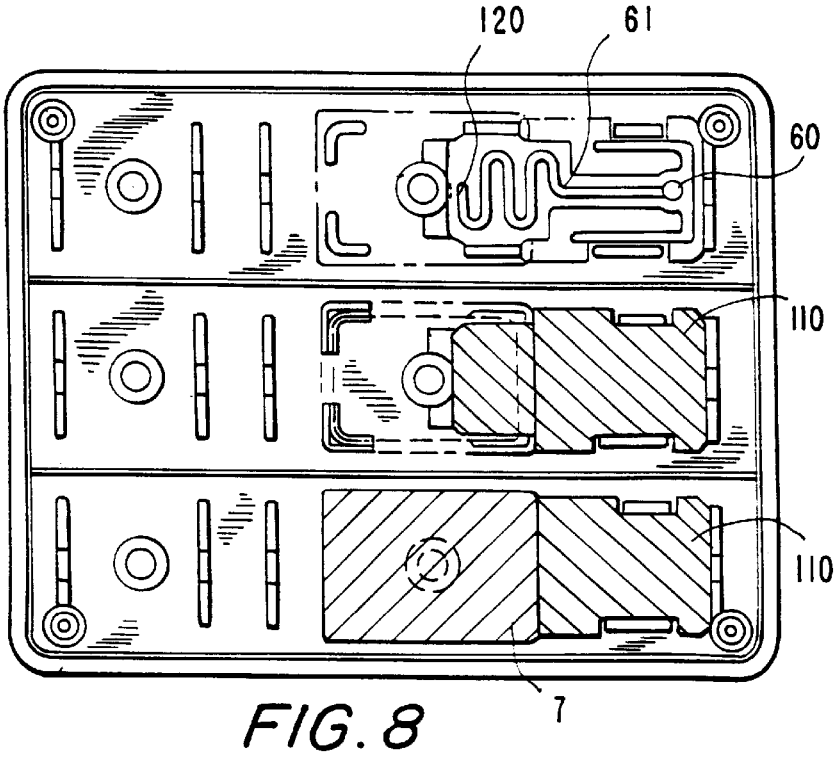
FIG. 8 is a bottom view of the cover, each compartment containing a different configuration of sealing members.

Reference is made to FIGS. 6 and 8, in which a second embodiment of the cover for use with a multi-color ink cartridge with multiple ink compartments constructed in accordance with the invention is shown. Like numerals are used to indicate like structures, the primary difference being the use of seals removing the need for stoppers in the vents and ports.

Figure 7A:
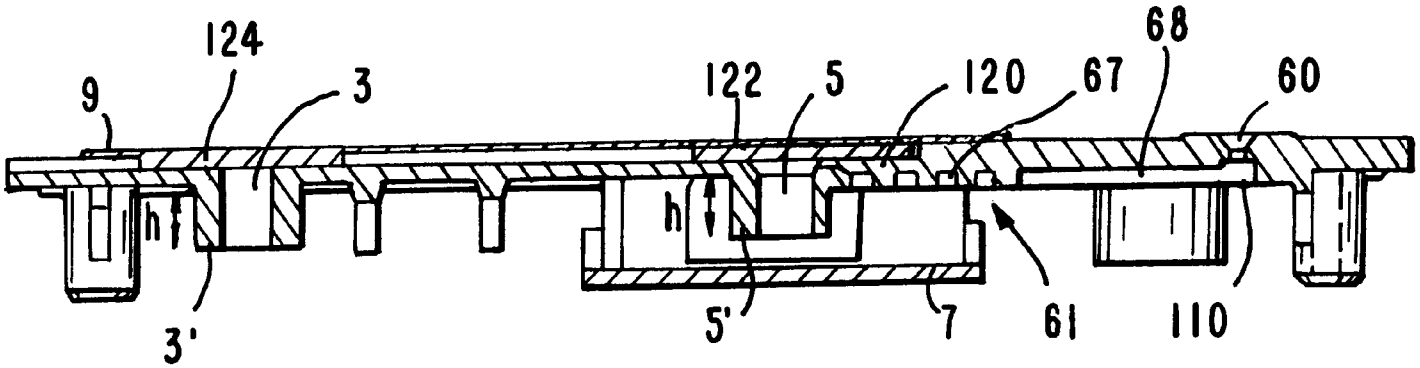
FIGS. 7(*a*) and 7(*b*) is a cross-sectional view taken along line 7—7 of FIG. 6 showing two alternative embodiments of the seal.
Figure 7B:
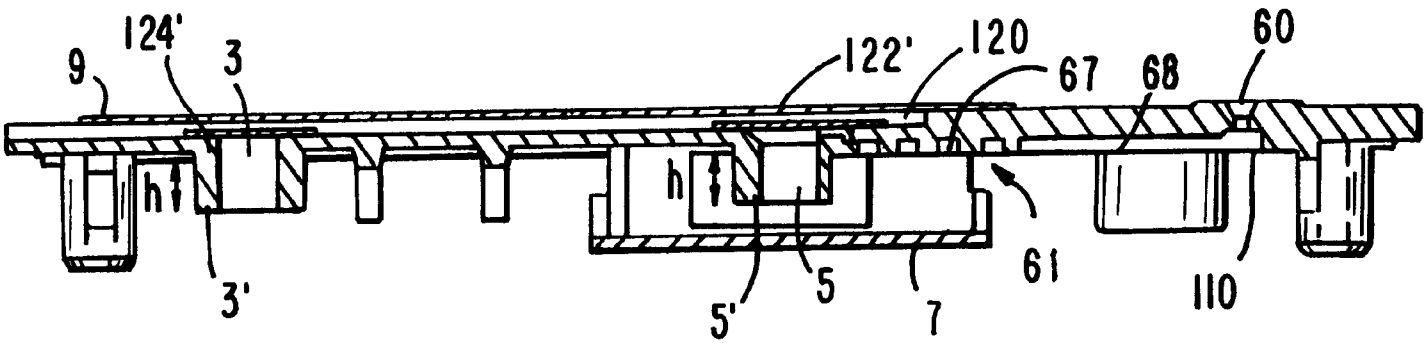

Recessed portions 100 are formed around ink charging port 3 and air vent 5, each individual ink compartment containing its own ink charging port 3 and air vent 5. A circular seal member 122, 124 (FIG. 7(*a*) made of gas-impermeable material may be fitted into any of the recessed portions 100 to close any of the ports or vents. Recessed portions 100 are each intended to receive a circular seal member 122 or 124 after this circular seal member has been laminated to a sheet seal member 9. The sheet seal member 9 will retain each of the circular seal members 122, 124 in the appropriate place, so when the entire seal 9 is placed on the top of the ink tank cover, each of the circular seal members 122, 124 will properly sit in a corresponding recessed portion 100. Thus, it is possible to fix one or a plurality of circular seal members 122, 124 to sheet seal member 9 and allow an airtight seal to be formed in each recessed portion 100, even if sheet seal member 9 is not formed of an airtight material. Grooves 101 are formed in cover 2 to allow air to escape when seal member 9 is adhered to the cover, seal member 9 being smoothly applied to the cover. When grooves 101 are formed in cover 2, charging port 3 and air vent 5 may be sealed by circular seal members 124 and 122 respectively. In a preferred embodiment, recessed portion 100 encompassing both ink charging port 3 and air vent 5 may be sealed by the use of circular seal members 124, 122 respectively fixed to sheet seal member 9, as shown in FIG. 7(*a*) rather than using stoppers 4 and 6 as shown in FIG. 2. In an alternative embodiment, circular seal members 124' and 122' may seal charging port 3 and air vent 5 without being fixed to seal member 9, as shown in FIG. 7(*b*).

As noted above, circular seal members are retained within recesses 100 after being fixed by a sheet seal member 9 or by a separate adhesive and are placed on the ink cartridge after the ink cartridge is filled with ink. While shown as being circular, any shape for seal members 122, 124, 122' and 124' may be used. Cover 2 is formed to define a air communication passage 61 travelling from each communication duct 120 to the associated air vent port 60. channel 18*b* are formed in a circuitous manner so as to place the inside of ink tank 1 in fluid communication with ambient air, while preventing any ink from evaporating. Therefore, ink which may normally evaporate when directly exposed to ambient air may be used in an ink cartridge using such an air vent and groove construction.

FIGS. 7(*a*) and (*b*) show air communication passage 61 (formed from channel 67 and space 68); which places air vent 5 and air vent 60 in fluid communication through communication duct 120. Ink charging port 3 and air vent 5 are each formed with a collar 3' and 5' respectively projecting into the inside of tank 1 to a height h sufficient to prevent ink from entering either port 3 or vent 5 even if the ink cartridge is turned upside down. The required height h is determined by measuring the amount of ink which leaks from ink absorbing member 8 during a heat cycle test or the like. It is important to keep ink from entering the port or vent since any ink in vent 5 may impede the flow of air through air communication passage 61 from ambient air vent 60 to air vent 5. However, even if ink were to enter air communication passage 61, the cross-sectional area of air communication passage 61 is dimensioned to be larger than the cross-sectional area of the ink printer nozzle. Therefore, any ink entering into air communication passage 61 would be returned via capillary force back to the interior of ink tank 1 because of the relative sizes of the cross-sectional areas of air communication passage 61 and the ink nozzle. Further, if moisture contained in the ink evaporates, and the viscosity of the ink increases, thereby further impeding the flow of air through air communication passage 61, the suction pump used by the ink-jet printer to remove ink from ink absorbing member 8 through the ink nozzle will suction ink from air communication passage 61, and thereby allow air to freely flow through air communication passage 61.

Reference is now made to FIG. 8 which depicts circuitous groove 61. Air communication passage 61 is closed off by a groove seal member 110 formed from a gas-impermeable material. Groove seal member 110 thereby encloses grooves 61 and forms capillary channels thereof. Thus, air can flow to and from the interior of ink tank 1 through air vent 5, circuitous channel 61, and ambient air vent 60, thereby allowing ventilation to the ink supply tank while preventing evaporation of ink.

Reference is now again made to FIG. 1, wherein ink supply port 10 is shown in enlarged form. Ink supply port 10 includes an inward projecting portion 11 and an outward projecting portion 12. Inward projecting portion 11 projects inward into ink cartridge main body 1 to bias ink absorbing member 8. Outward projecting portion 12 projects outward from ink cartridge main body 1 to position ink cartridge main body 1. Inward projecting portion 11 assists the flow of ink within ink absorbing member 8 to ink supply port 10 by compressing ink absorbing member 8 in the area adjacent inward projecting portion 11 to produce an average pore diameter of ink absorbing member 8 at this location smaller than the average pore diameter of absorbing body 8 at locations not adjacent inward projecting portion 11. This reduction in the average pore diameter in the vicinity of inward projecting portion 11 increases the capillary force, assisting the ink flow to ink supply port 10. Mesh filter 34 is positioned at the end of inwardly projecting portion 11 to assist in preventing particles and air bubbles from entering the ink supply port. Outward projecting portion 12 positions ink cartridge main body 1 by engaging a plurality of ribs 13 arranged on the circumferential surface of ink cartridge main body 1 with an annular positioning projected edge 33 disposed on the back of the recording head and also aids in connecting ink supply port 10 to ink supply needle 31.

A stepped insertion hole 14 in outward projecting portion 12 is dimensioned to receive a self-aligning ring 20 (described below). In addition, a through-hole 16 serving as an ink through-hole (part of the ink supply port) is provided in inward projecting portion 11. Stepped insertion hole 14 and through-hole 16 are formed coaxially so as to communicate with each other when ink cartridge main body 1 is coupled with ink supply needle 31 of the recording head.

Self-aligning ring 20 will now be described with reference to FIG. 1. Self-aligning ring 20 is made of a flexible resin material and comprises three distinct portions. A ring-like annular needle seal 21 (the first seal) having a circular form in section is coupled with a ring-like annular port seal 22 (the second seal) having a circular form in section by a thin truncated conical connecting ring 23 that is thinner than annular needle seal 21 or annular port seal 22 in the axial direction. The inner diameter of annular needle seal 21 is slightly smaller than the outer diameter of ink supply needle 31. The outer diameter of annular port seal 22 is slightly larger than the inner diameter of an entrance portion 14*a* of stepped insertion hole 14.

A ring-like movable bush 24 having an L-shaped form in cross section is fitted adjacent annular needle seal 21 from outside so as to suppress the expansion of needle seal 21. The inner diameter of movable bush 24 is substantially smaller than the inner diameter of a portion 14*b* of stepped insertion hole 14. In addition, a ring-like fixed bush 25 having an L-shaped form in section is positioned within annular port seal 22 so as to insure fixed bush 25 remains in contact with the inner surface of entrance portion 14*a* of stepped insertion hole 14. Fixed bush 25 is dimensioned so that the inner end of fixed bush 25 does not come in contact with needle seal 21. Fixed bush 25 guides ink supply needle 31 into stepped insertion hole 14 during insertion. Fixed bush 25 is mounted in such a manner that movable bush 24 is in sliding contact with stepped portion 15 within stepped insertion hole 14 and that fixed bush 25 is fitted into entrance portion 14*a* of insertion hole 14.

Radially extending grooves 24*a* (see FIG. 1(*a*)) are formed on the surface of movable bush 24 and are maintained in sliding contact with stepped portion 15 within stepped insertion hole 14. When ink is injected into ink cartridge main body 1, ink cartridge main body 1 is evacuated to a negative pressure. A plurality of through-holes 24*b* and grooves 24*a* are formed in movable bush 24 (see FIG. 1(*a*))so that essentially all of the air within stepped insertion hole 14 can be released from around self-aligning ring 20 through through-holes 24*b* between grooves 24*a*. Specifically, as is shown in FIG. 1, air is released from area 14 through grooves 24*a*, from area 240*b* through through-holes 24*b*, and from area 250*a* through through-holes 25*a*. These additional through holes 25*a* are formed in fixed bush 25 for this same purpose. The releasing of the air in this manner prevents the ink charging pressure from causing self-aligning ring 20 from being detached from insertion hole 14. In effect, during injection of the ink into ink cartridge body 1 under negative pressure, ink essentially occupies the portion of insertion hole 14 not occupied by self-aligning ring 20, movable bush 24, and fixed bush 25.

Second seal member 17 in FIG. 1 seals the opening end of ink supply port 10, and is penetrated by ink supply needle 31 during mounting of the ink supply cartridge.

An electrode 35 extends through a bore 36 in a wall of ink cartridge body 1 and serves as one electrode of an ink exhaustion sensor to inform the user that the ink cartridge requires replacement. An O-ring 37 prevents escape of ink through bore 36.

As is shown in FIG. 2, ink charging port 3 is formed in a position opposed to through-hole 16 of inward projecting portion 11. Thus, upon injection of ink into the ink tank, the tip end of an ink injection needle is located in the vicinity of through-hole 16, making it possible to ensure filling through-hole 16, and the rest of the ink tank, with ink without leaving air bubbles therein. In addition, since the end of electrode 35, which is used for detecting the depletion of ink from the ink chamber is disposed in through-hole 16, it is therefore possible to eliminate errors in the detection of the depletion of ink which may be caused by air bubbles situated in through-hole 16.

When filling the interior of ink tank 1 with ink, air vent 5 is used to evacuate air from the interior of ink tank 1 to produce a vacuum in ink tank 1 whereby ink will be drawn into ink tank 1. To fill the ink cartridge with ink, evacuating means are attached to air vent 5 and the pressure in the interior of the ink tank is reduced. When the pressure is reduced to a predetermined level, the evacuating operation is stopped and air vent 5 is closed. Thereafter, ink charging port 3 is placed in fluid communication with a measuring tube (not shown) filled with ink. Ink contained in the measuring tube is drawn into the evacuated container and is then absorbed by ink absorbing member 8. After the specified amount of ink flows into the container, ink charging port 3 is sealed with stopper 4(or circular seal member 124, 124', thereby stopping any ink from leaking out of ink charging port 3. After sealing air vent 5, air vent 5 is in fluid communication with air communication package 61, and ambient air vent 60 to ventilate the ink chamber.

Figure 3:
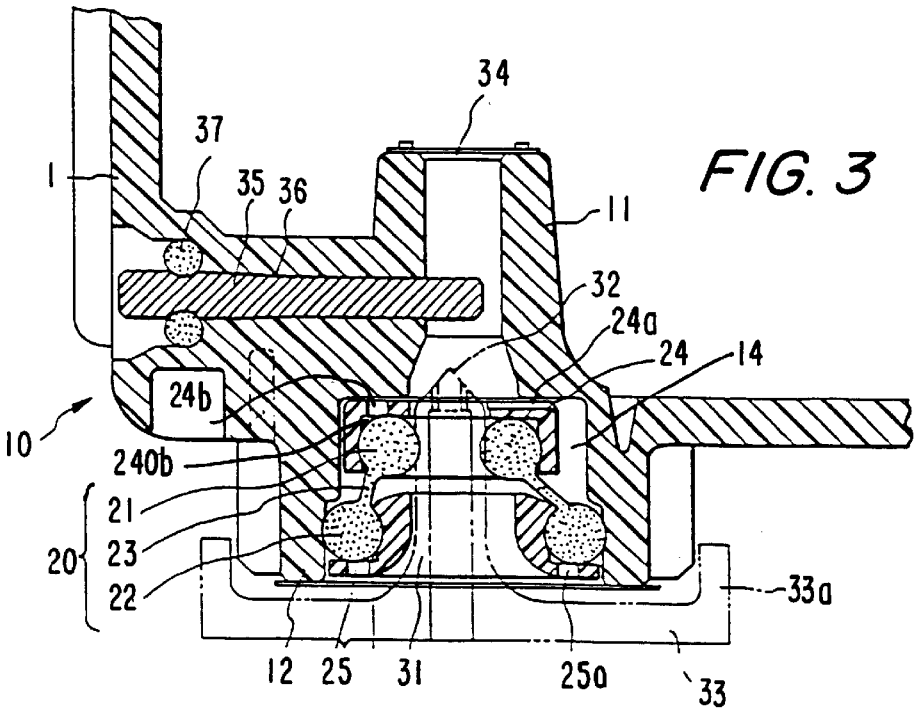
FIG. 3 is a fragmentary enlarged cross-sectional view of the ink cartridge and recording combination of FIG. 1 illustrating the operation of the invention where the ink supply needle is not properly aligned.

The procedure for attaching ink cartridge main body 1 to a recording head will now be described. Ink cartridge main body 1 is coupled with the recording head in such a manner so as to align ink supply port 10 with ink supply needle 31. Ink supply needle 31 is inserted into ink supply port 10 while piercing seal member 17 that seals ink supply port 10. Ink supply needle 31 then enters into through-hole 16 and is hermetically fitted with movable bush 24. Simultaneously therewith, ribs 13 disposed around the circumference of the outward projecting portion 12 are fitted into annular positioning projected edge 33*a* of positioning member 33 disposed on the recording head to thereby fix ink cartridge main body 1 in position. Ink cartridge main body 1 is attached to the recording head so as to align ink supply needle 31 with positioning projected edge 33 even if ink supply needle 31 is not projected precisely coaxial with through-hole 16, or if ink supply needle 31 does not project precisely perpendicularly from the recording head. As shown in FIG. 3, ink supply needle 31 is hermetically fitted to needle seal 21 even if not properly situated without greatly deforming needle seal 21. Needle seal 21 moves with movable bush 24 along stepped portion 15 within insertion hole 14 upon insertion of tapered tip portion 32 of ink supply needle 31, and thin conical connecting ring 23 is deformed and displaced in the radial direction outward. Thus, ink supply needle 31 is correctly fitted regardless of the precise position or angle of ink supply needle 31. Reference is now made to FIG. 3 which depicts the positioning of the movable bush 24 and self-aligning ring 20 when an ink supply needle 31 is not aligned with the axis of insertion hole 14.

Figure 4:
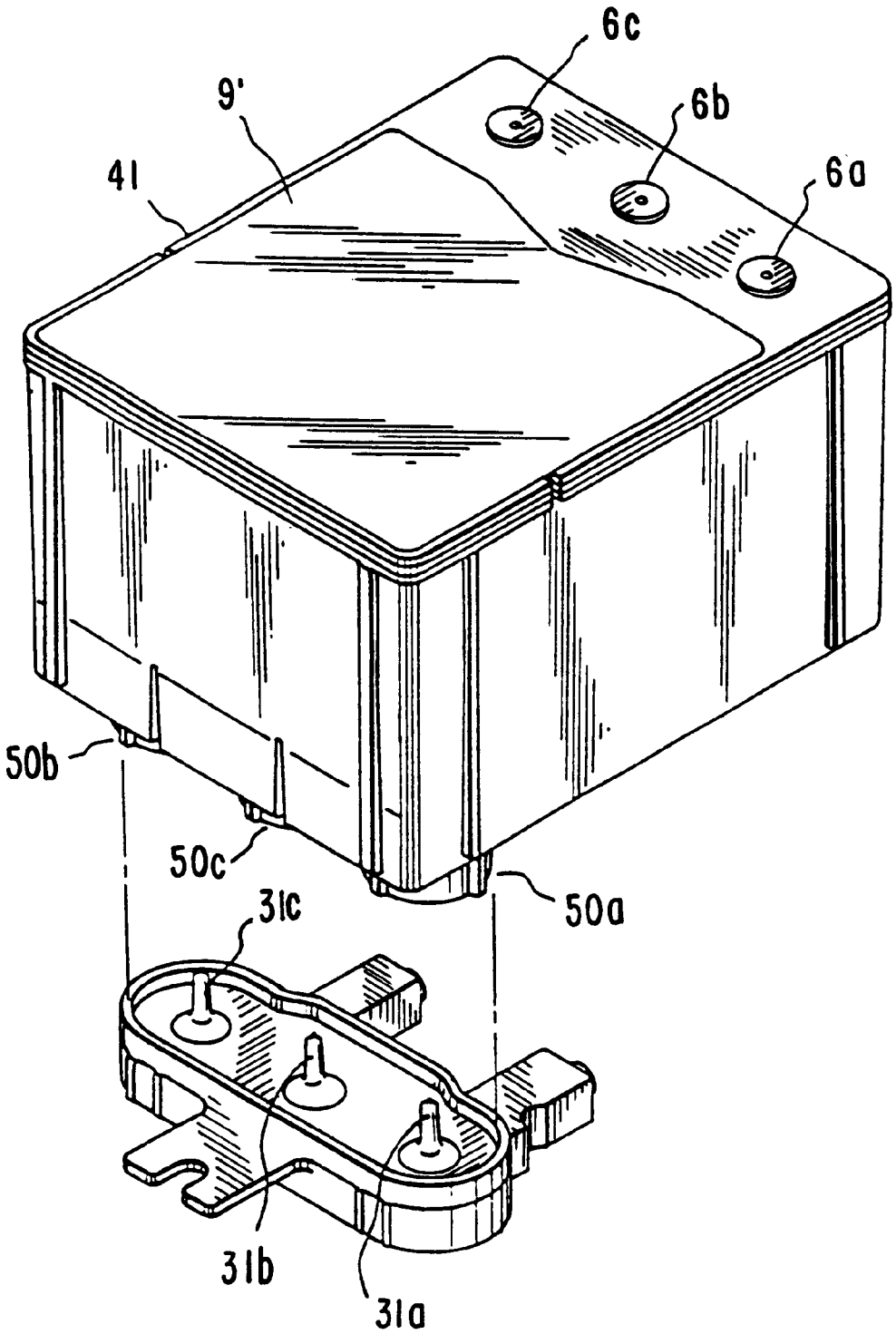
FIG. 4 is an exploded perspective view of a multi compartment ink cartridge for color printing and associated recording head combination constructed in accordance with a second embodiment of the present invention.
Figure 5:
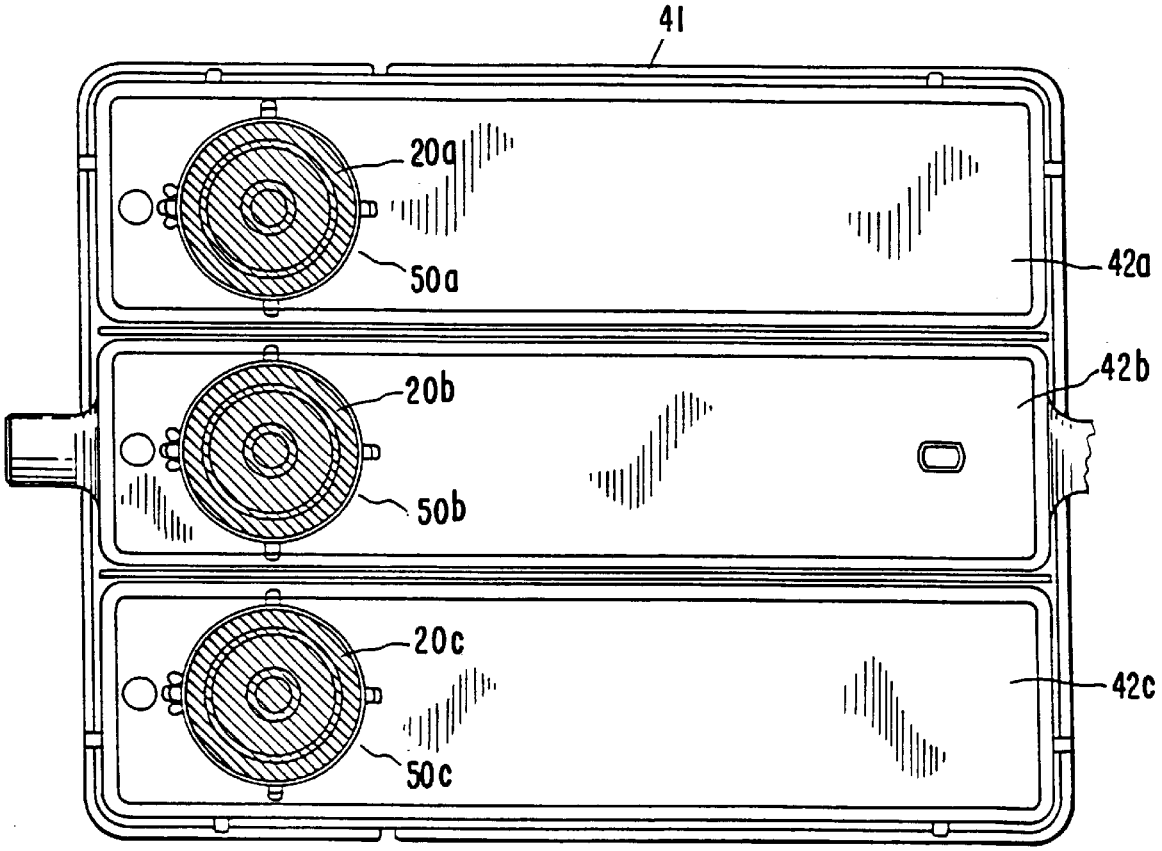
FIG. 5 is a bottom plan view of the ink cartridge of FIG. 4 constructed in accordance with the second embodiment of the present invention.

Reference is now made to FIGS. 4 and 5 wherein a second embodiment of the present invention is shown, like elements being given like reference numerals. This second embodiment depicts a mechanism for use with color or other multi-ink printers. A cartridge main body 41 has a plurality of ink tanks or compartments 42*a*, 42*b*, 42*c* fixed integrally thereto for containing different color inks. Ink supply ports 50*a*, 50*b*, SOc having similar self-aligning rings 20*a*, 20*b*, 20*c* are disposed on the bottoms of ink tanks 42*a*, 42*b*, 42*c*. Each ink tank 42*a*, 42*b* and 42*c* has an air vent sealed by a stopper 6*a*, 6*b* and 6*c* respectively (FIG. 4). The ink charging ports of the three ink tanks or compartments are covered and sealed by sheet member 9'.

In the situation where ink cartridge 41 is attached to a recording head having inconsistent positioning tolerances among ink supply needles 31*a*, 31*b*, 31*c* (FIG. 5), self-aligning rings 20*a*, 20*b*, 20*c*inside the ink supply ports 50*a*, 50*b*, 50*c*are designed so that the misaligned ink supply needles displace the respective needle seals 21 and movable bushes 24 as described above so as to align each needle seal 21 with the position of the corresponding ink supply needle 31*a*, 31*b*, 31*c* while flexing each corresponding thin conical connecting ring 23. This construction thereby prevents the ink from leaking, and permits fitting and retaining each ink supply needle 31*a*, 31*b*, 31*c* hermetically with the corresponding needle seal 21 by only deforming the thin connecting members 23.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink cartridge for supplying ink to a recording head, comprising:

an ink cartridge main body having a plurality of walls and an exterior and an interior;

an ink supply port disposed in a first of said plurality of walls of said ink cartridge main body and communicating from the interior to the exterior of said ink cartridge main body to permit the flow of ink therethrough; and a cover having an internal surface shaped to define a second of said plurality of walls of said interior of said ink cartridge main body, an ambient air vent formed in said cover in fluid communication with ambient air, an air communication passage formed at least in part in said internal surface of said cover and said air communication passage having a first end and a second end and being in fluid communication at said first end of said passage with said ambient air vent, and a further air vent formed in said cover and in fluid communication with said air communication passage at the second end of said passage and with the interior of said ink cartridge main body, the interior of said ink cartridge main body being placed in fluid communication with ambient air through said air communication passage and said further air vent and said ambient air vent.

2. The ink cartridge of claim 1, further comprising a recess formed in said cover disposed surrounding said further air vent, and further comprising a seal member dimensioned to be inserted into said recess and form a seal to prevent passage of ink and air through said further air vent directly to the exterior of the cartridge, while not preventing said interior of said ink cartridge main body to be in fluid communication with ambient air through said further air vent, said air communication passage and said ambient air vent.

3. The ink cartridge of claim 2, further comprising a sheet seal member, said sheet seal member overlaying said seal member.

4. The ink cartridge of claim 1, said air communication passage at least in part being formed by a circuitous channel formed at least in part in said internal surface of said cover and including a channel seal member overlying said circuitous channel to define at least part of said air communication passage.

5. The ink cartridge of claim 4, wherein the recording head includes a printer nozzle; the printer nozzle having a passage therethrough and said circuitous channel has a cross-sectional area selected to be larger than a cross-sectional area of the passage through the nozzle of the printer.

6. The ink cartridge of claim 1, wherein said cover further comprises an ink charging port.

7. The ink cartridge of claim 6, wherein said ink supply port is positioned in a wall facing said cover so that said ink charging port is opposed to said ink supply port.

8. The ink cartridge of claim 6, further comprising a recess formed in said cover disposed surrounding said ink charging port, and further comprising a circular seal member dimensioned to be inserted into said recess and form a seal to prevent passage of ink and air out through said ink charging port.

9. The ink cartridge of claim 8, further comprising a sheet seal member, said sheet seal member overlaying said seal member.

10. The ink cartridge of claim 6, further comprising a collar surrounding and projecting into said ink tank from said ink charging port a distance sufficient to prevent ink from entering said ink charging port even if said ink cartridge is turned upside down.

11. The ink cartridge of claim 1, further comprising a collar surrounding and projecting into said ink tank from said further air vent a distance sufficient to prevent ink from entering said further air vent and said air communication passage even if said ink cartridge is turned upside down.

12. The ink cartridge of claim 1, wherein said ink cartridge main body comprises a plurality of walls formed integrally therein, said plurality of walls defining a plurality of compartments, said plurality of walls including at least one internal wall defining each compartment and preventing the flow of ink between adjacent compartments, at least two of said compartments holding different colors of ink, a plurality of ink supply ports disposed,in said second wall of said ink cartridge main body, a respective ink supply port communicating from the exterior of said ink cartridge to the interior of each of said plurality of compartments, respectively, to permit the flow of ink therethrough; said cover defining one wall of each of said compartments and including, in the portion of said cover defining a wall of each of said compartments, a respective one of each of a plurality of ambient air vents, further air vents and air communication passages therebetween.

13. An inkjet type recording apparatus for outputting ink onto a recording medium, comprising:

a recording head for ejecting ink; and an ink cartridge coupled to said recording head for supplying ink to a recording head, including:

an ink cartridge main body having a plurality of walls, an interior and an exterior;

an ink supply port disposed in a first of said plurality of walls of said ink cartridge main body and communicating from the interior to the exterior of said ink cartridge main body for the flow of ink therethrough; and a cover having an interior surface adapted to seal said ink cartridge main body, an ambient air vent formed in said cover in fluid communication with ambient air, an air communication passage formed at least in part in said internal surface of said cover and said air communication passage having a first end and a second end and being in fluid communication at said first end of said air communication passage with said ambient air vent, and a further air vent formed in said cover and in fluid communication with said air communication passage al the second end of said air communication passage and with the interior of said ink cartridge main body, the interior of said ink cartridge main body being placed in fluid communication with ambient air through said air communication passage and said further air vent and said ambient air vent.

14. The ink-jet type recording apparatus of claim 13, further comprising a recess formed in said cover disposed surrounding said further air vent, and further comprising a seal member dimensioned to be inserted into said recess and form a seal to prevent passage of ink and air directly through said further air vent to the exterior of the cartridge, while not preventing said interior of said ink cartridge main body to be in fluid communication with ambient air through said further air vent, said air communication passage and said ambient air vent.

15. The ink-jet type recording apparatus of claim 14, further comprising a sheet seal member, said sheet seal member overlaying said seal member.

16. The ink-jet type recording apparatus of claim 13, said air communication passage at least in part being formed by a circuitous channel formed at least in part in said internal surface of said cover and including a channel seal member overlying said circuitous channel to define at least part of said air communication passage.

17. The ink-jet type recording apparatus of claim 16, wherein said recording head includes a printer nozzle and said channel has a cross-sectional area larger than the cross-sectional area of the passage through said printer nozzle.

18. The inkjet type recording apparatus of claim 13, wherein said ink cartridge main body comprises a plurality of compartments formed integrally, said plurality of walls defining a plurality of compartments, said plurality of walls including at least one internal wall defining each compartment and preventing the flow of ink between adjacent compartments, at least two of said compartments holding different colors of ink, said cover defining one wall of each of said compartments a respective one of each of a plurality of ambient air vents, further air vents and air communication passages therebetween in said cover disposed in each of said compartments.

19. An ink supply system for supplying ink to a recording head of an ink-jet type recording apparatus, comprising:

an ink cartridge for supplying ink to the recording head, including:

an ink cartridge main body having a plurality of walls, an interior and an exterior;

an ink supply port disposed in a wall of said ink cartridge main body and communicating from the interior to the exterior of said ink cartridge for the flow of ink therethrough; and a cover having an internal surface adapted to seal said ink cartridge main body, an ambient air vent formed in said cover in fluid communication with ambient air, an air communication passage formed at least in part in said internal surface of said cover in fluid communication at one end of said passage with said ambient air vent, and a further air vent formed in said cover and in fluid communication with said air communication passage at the other end of said passage and with the interior of said ink cartridge main body, the interior of said ink cartridge main body being placed in fluid communication with ambient air through said air communication passage and air vents.

20. The system of claim 19, further comprising a recess formed in said cover disposed surrounding said further air vent, and further comprising a seal member dimensioned to be inserted into said recess and form a seal to prevent passage of ink and air directly through said further air vent to the exterior of the cartridge while not preventing said interior of said ink cartridge main body to be in fluid communication with ambient air through said further air vent, said air communication passage and said ambient air vent.

21. The system of claim 20, further comprising a sheet seal member, said sheet seal member overlaying said seal member.

22. The system of claim 21, said air communication passage at least in part being formed by a circuitous channel formed at least in part in said internal surface of said cover and including a channel seal member overlying said circuitous channel to define at least part of said air communication passage.

23. The system of claim 22, wherein said recording head includes a printer nozzle said recording head including a channel and said circuitous channel has a cross-sectional area larger than the cross-sectional area of the passage through said printer nozzle.

24. The system of claim 19, wherein said ink cartridge main body comprises a plurality of walls defining a plurality of compartments formed integrally therein, said plurality of walls including at least one internal wall defining each compartment and preventing the flow of ink between adjacent compartments, at least two of said compartments holding different colors of ink, said cover defining one wall of each of said compartments and including, in the portion of said cover defining a wall of each of said compartments, a respective one of each of a plurality ambient air vents, further air vents and air communication passages therebetween.

* * * * *